US007815460B2

(12) United States Patent
Lin

(10) Patent No.: US 7,815,460 B2
(45) Date of Patent: Oct. 19, 2010

(54) CONNECTOR WITH AN ANTI-LOOSE FASTENING DEVICE

(75) Inventor: Miao-Ting Lin, Sijhih (TW)

(73) Assignee: Lan Accessories Co., Ltd., Sijhih, Taipei Hsien (TW)

( * ) Notice: Subject to any disclaimer, the term of this patent is extended or adjusted under 35 U.S.C. 154(b) by 0 days.

(21) Appl. No.: 12/631,682

(22) Filed: Dec. 4, 2009

(65) Prior Publication Data

US 2010/0151720 A1 Jun. 17, 2010

(30) Foreign Application Priority Data

Dec. 12, 2008 (TW) ..... 97222259 U

(51) Int. Cl.
*H01R 13/627* (2006.01)

(52) U.S. Cl. ..... 439/358

(58) Field of Classification Search ..... 439/358, 439/620.1, 352–357, 571, 607, 108
See application file for complete search history.

(56) References Cited

U.S. PATENT DOCUMENTS 5,727,963 A * 3/1998 LeMaster ..... 439/358
6,056,578 A * 5/2000 Lin ..... 439/358
6,099,339 A * 8/2000 Yanagida et al. ..... 439/358
6,146,183 A * 11/2000 Jinno et al. ..... 439/358
6,328,601 B1 * 12/2001 Yip et al. ..... 439/607.08
6,394,824 B1 * 5/2002 Huang ..... 439/108
6,508,678 B1 * 1/2003 Yang ..... 439/677
6,890,205 B1 * 5/2005 Wu ..... 439/358
6,902,432 B2 * 6/2005 Morikawa et al. ..... 439/607.41
7,033,225 B2 * 4/2006 Belanger, Jr. ..... 439/668
7,128,595 B2 * 10/2006 Boutros ..... 439/358
7,160,137 B1 * 1/2007 Yeh ..... 439/358
7,581,978 B1 * 9/2009 Briant ..... 439/358
2002/0090856 A1 * 7/2002 Weisz-Margulescu ..... 439/358
2006/0019526 A1 * 1/2006 Jeon ..... 439/358
2007/0004265 A1 * 1/2007 Yeh ..... 439/358
2007/0141890 A1 * 6/2007 Koyama ..... 439/358

* cited by examiner

*Primary Examiner*—T C Patel
*Assistant Examiner*—Harshad C Patel
(74) *Attorney, Agent, or Firm*—patenttm.us

(57) ABSTRACT

A connector with an anti-loose fastening device has a housing, a socket module mounted inside the housing, and a plug module. The housing has a front opening for the plug module to insert in the socket module so as to electrically connect therewith. The housing has an elastic finger. The elastic finger has a tooth extending downwardly from one end thereof, and an inwardly slanted surface facing the front opening. When the plug module inserts in the socket module, the tooth of the elastic finger inserts in a recess formed on the plug module so as to prevent the plug module from disengaging with the socket module inside the housing.

5 Claims, 6 Drawing Sheets

CONNECTOR WITH AN ANTI-LOOSE FASTENING DEVICE

BACKGROUND OF THE INVENTION

1. Field of the Invention

The present invention is related to a connector with an anti-loose fastening device, and more particularly to a connector interfacing with computer peripherals and reinforcing connection therewith.

2. Description of the Related Art

Consumer electronics, such as digital camera, DV camcorder and the like, progress each passing day. What remains unchanged is the pursuit of compact size, large capacity and fast transmission speed. Data transmission between different information equipment relies on connection interfaces therebetween, for example, USB interface. As regular connection interfaces are connected by wires or cables, in an occasion full of computer equipment like office, studio and so on, connection cables distributed among computer equipment are easily pulled and dragged by passers-by to make cables disconnected with computer equipment and further cause interrupt to transmission. Such interrupt certainly results in inconvenience and data loss in operation, and even damages the connected equipment sometimes.

Although wired connection is still widely adopted as a more stable connection means than wireless connection, the protection for maintaining a normal connection state between interfaces connected by cables or wires still needs to be refined.

SUMMARY OF THE INVENTION

An objective of the present invention is to provide a connector with an anti-loose fastening device preventing a plug module from easily disengaging with a socket module after the plug module is inserted in and connected with the socket module.

To achieve the foregoing objective, the connector with an anti-loose fastening device has a housing with a chamber, a front opening, a through slot, and an elastic finger, and has a socket module and a plug module.

The housing has a chamber, a front opening, a through slot and an elastic finger. The chamber is defined in the housing. The front opening is formed through a front end of the housing. The through slot is formed through the housing and abuts the front end of the housing. The elastic finger is mounted inside the through slot and has one end connected with a rear edge of the through slot, the other end being a flexible free end abutting the front end of the housing, and a tooth extending downwardly from the free end and protruding downwardly beyond the through slot.

The socket module is mounted in the chamber, abuts the front opening, and has a circuit board, a socket and a transmission cable. The socket is connected to the circuit board and faces the front opening of the housing. The transmission cable is connected with the circuit board.

The plug module selectively inserts into and electrically connects with the socket module and has a grip portion having a recess formed thereon and corresponding to the tooth of the elastic finger on the top cover. The male plug is mounted on one end of the grip portion to electrically connect with the socket module.

When the plug module is inserted in the socket module inside the housing, the tooth of the elastic finger corresponds to a recess formed on the plug module and engages with the recess so as to fasten the connection of the plug module and socket module to prevent the plug module from easily disengaging with the socket module.

DETAILED DESCRIPTION OF THE INVENTION

Figure 1:
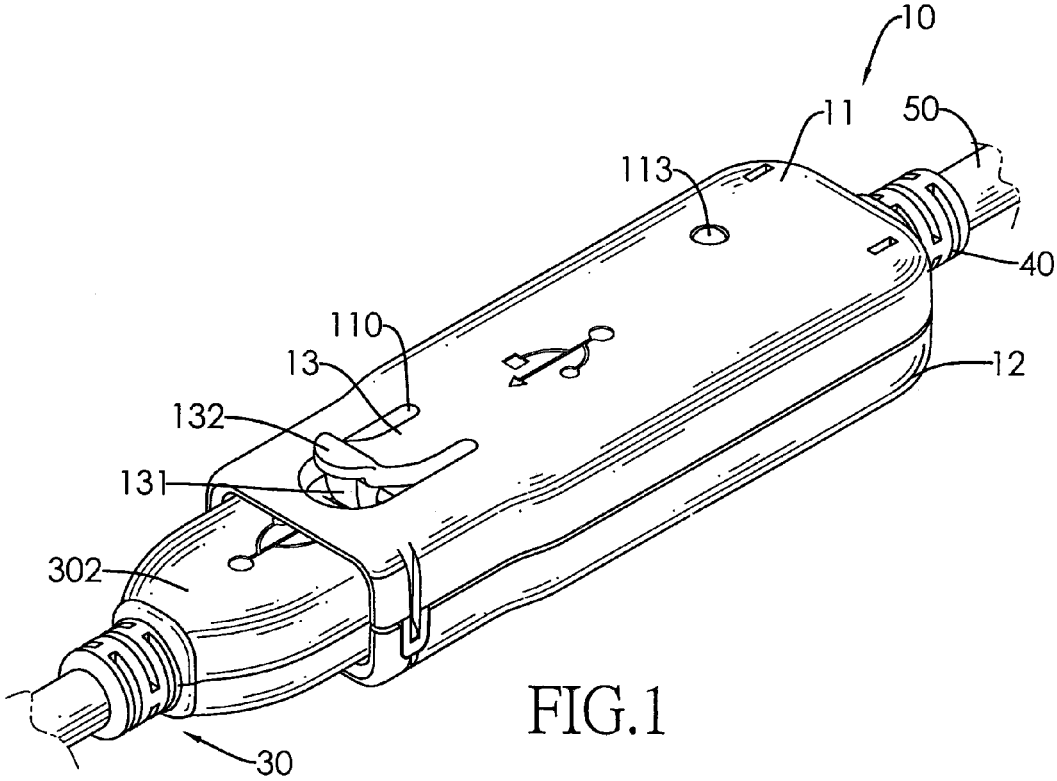
FIG. 1 is a perspective view of a connector with an anti-loose fastening device in accordance with the present invention.
Figure 2:
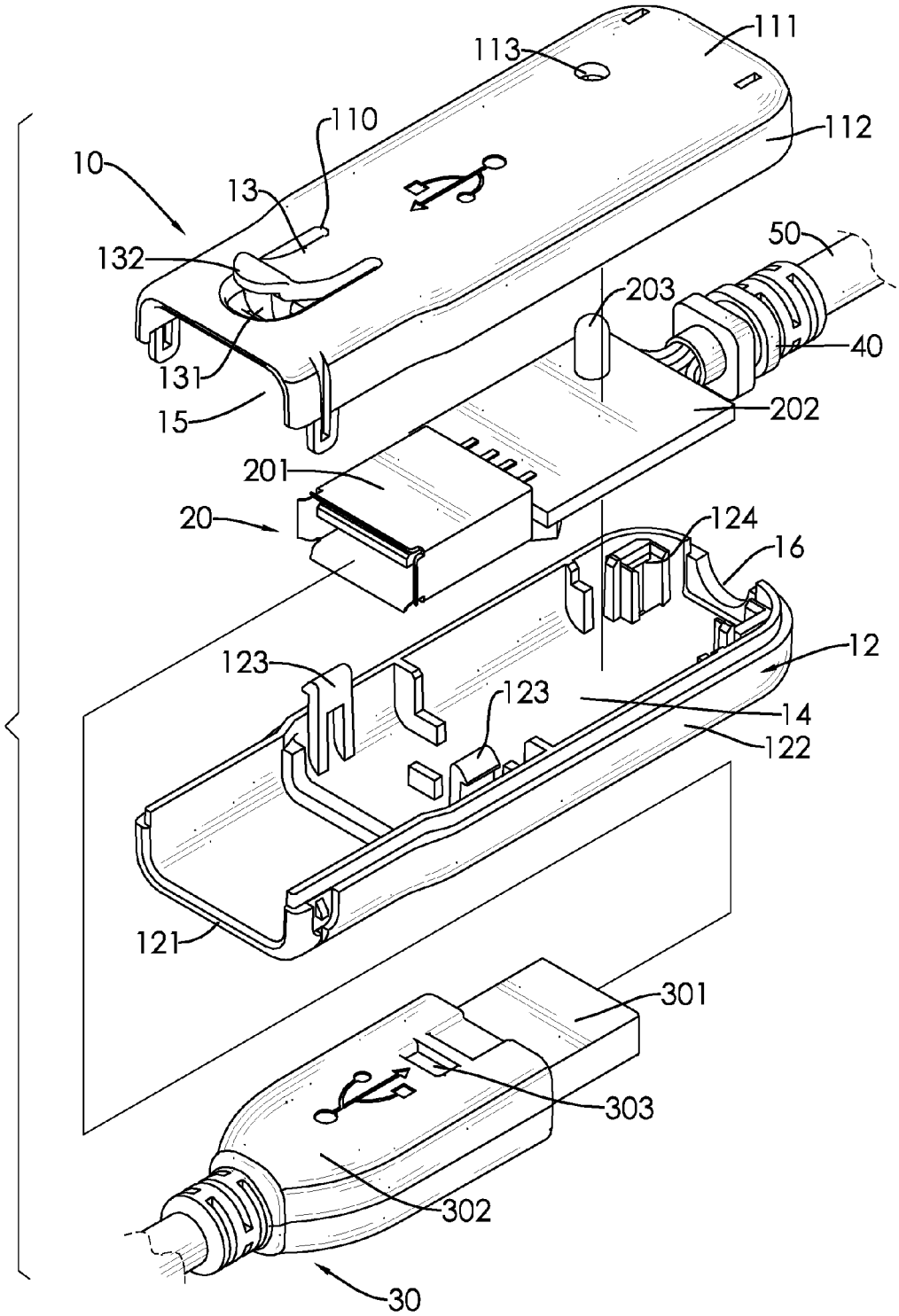
FIG. 2 is an exploded view of the connector with an anti-loose fastening device in FIG. 1.
Figure 3:
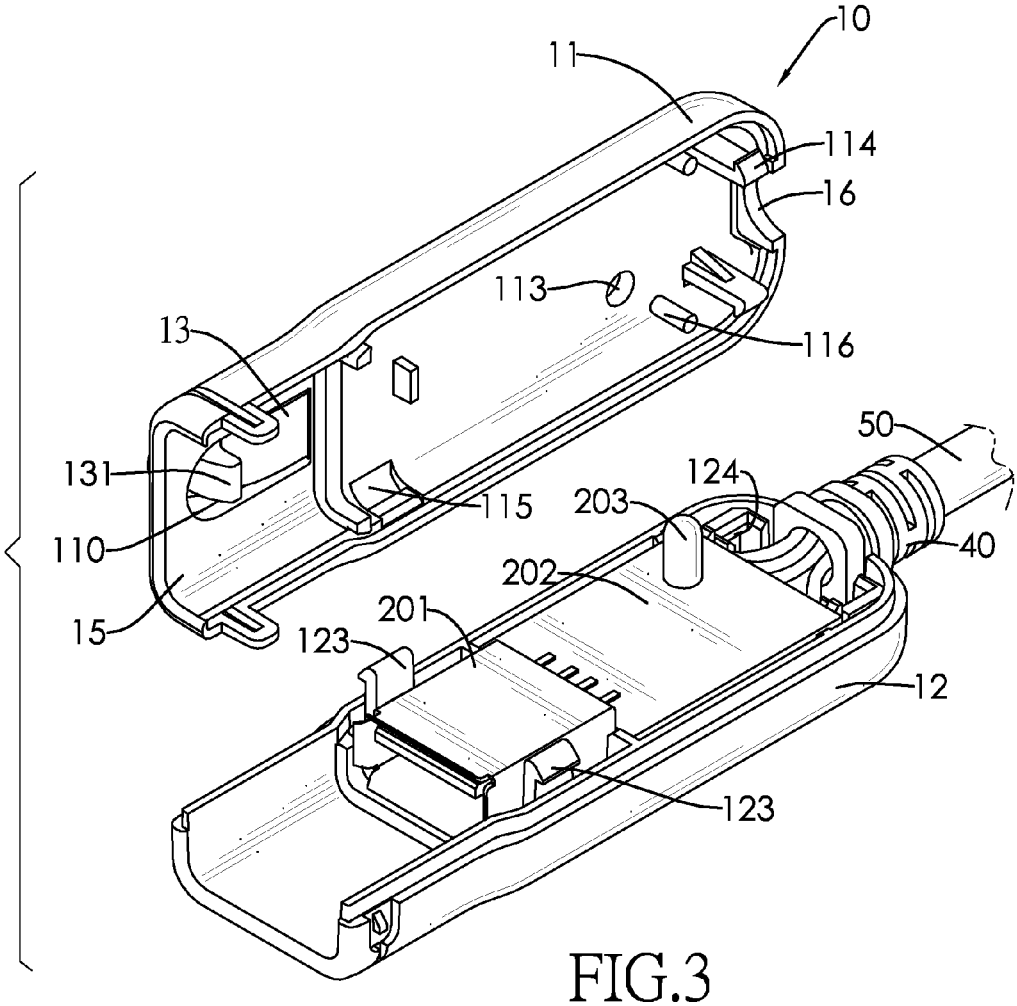
FIG. 3 is a partial exploded view of the connector with an anti-loose fastening device in FIG. 1.
Figure 4:
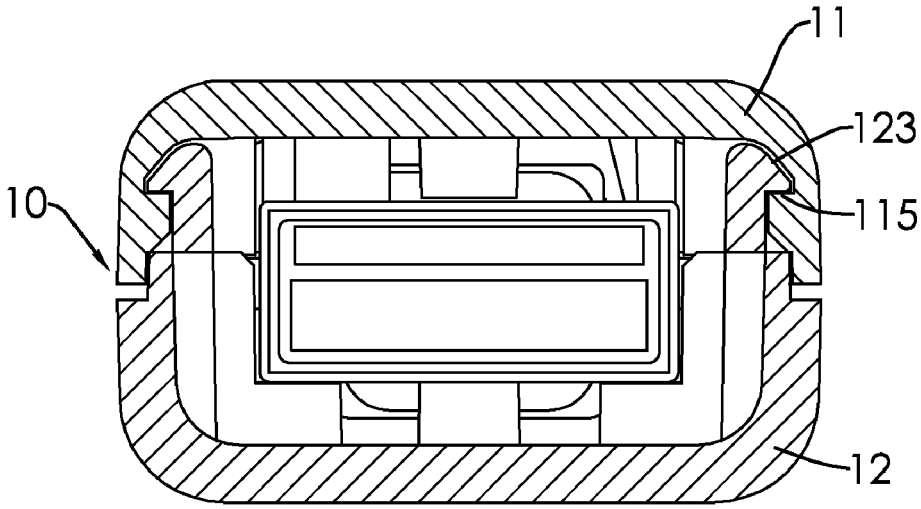
FIG. 4 is a cross-sectional view of the connector with an anti-loose fastening device in FIG. 1.

With reference to FIGS. 1 to 3, a connector with an anti-loose fastening device in accordance with the present invention has a housing (10), a socket module (20) and a plug module (30).

The housing (10) has a front opening (15), a rear opening (16), a top cover (11), a bottom cover (12) and a chamber (14).

The front opening (15) and the rear opening (16) are respectively formed through a front end and a rear end of the housing (10).

The top cover (11) has a top board (111) and two sidewalls (112). Each sidewall extends perpendicularly and downwardly from a corresponding edge of the top board (111) so that the top cover (11) is U-shaped in cross-section. The top cover (11) has a through slot (110) and an elastic finger (13), two upper grooves (115), two upper tongues (114), two pins (116) and an indicator hole (113). The through slot (110) is formed through a front portion of the top board (111). The elastic finger (13) is formed inside the through slot (110). One end of the elastic finger (13) is connected with a rear edge of the through slot (110), and the other end of the elastic finger (13) is a flexible free end. The free end has a release portion (132) and a tooth (131). The release portion (132) protrudes upwardly beyond the through slot (110). The tooth (131) extends downwardly from the free end, protrudes downwardly beyond the top board (111) and has an inwardly slanted surface facing the front opening (15).

With reference to FIG. 3, each upper groove (115) is formed in an inner periphery of a corresponding side wall (112). Each upper tongue (114) and each pin (116) are formed on an inside surface of the top board. The indicator hole (113) is formed through the top board (111).

The bottom cover (12) is attached to the top cover (11). Similarly, the bottom cover (12) has a bottom board (121) and two sidewalls (122). Each sidewall extends perpendicularly and upwardly from a corresponding edge of the bottom board (121) so that the bottom cover (12) is U-shaped in cross-section. The bottom cover (12) has two lower tongues (123) and two buckles (124). Each lower tongue (123) is formed on the bottom board (121) and engages with the corresponding upper groove (115) of the top cover (11). Each buckle (124) is formed on the bottom board (121) and engages with the corresponding upper tongue (114) of the top cover (11).

The chamber (14) is formed between the top and bottom covers (11, 12).

With further reference to FIG. 2, the socket module (20) is mounted inside the housing (10) and has a socket (201), a circuit board (202), an indicator (203), a cable seat (40) and a transmission cable (50). The socket (201) may be a USB socket. The circuit board (202) is connected with the socket (201). The pins (116) of the top cover (11) are urged against the circuit board (202) to fix the circuit board (202). The indicator (203) is mounted on the circuit board (202) and corresponds to the indicator hole (113) of the top cover (11). The cable seat (40) is received within the rear opening (16). The transmission cable (50) is connected to the cable seat (40) and is connected with the circuit board (202).

The plug module (30) selectively inserts into and electrically connect with the socket module (20) and has a male plug (301), a grip portion (302) and a recess (303). The male plug (301) may be a USB plug. The grip portion (302) is connected to the male plug (301). The recess (303) is formed in the grip portion (302) and selectively engages with the tooth (131) of the elastic finger (13) on the top cover (11).

Figure 5:
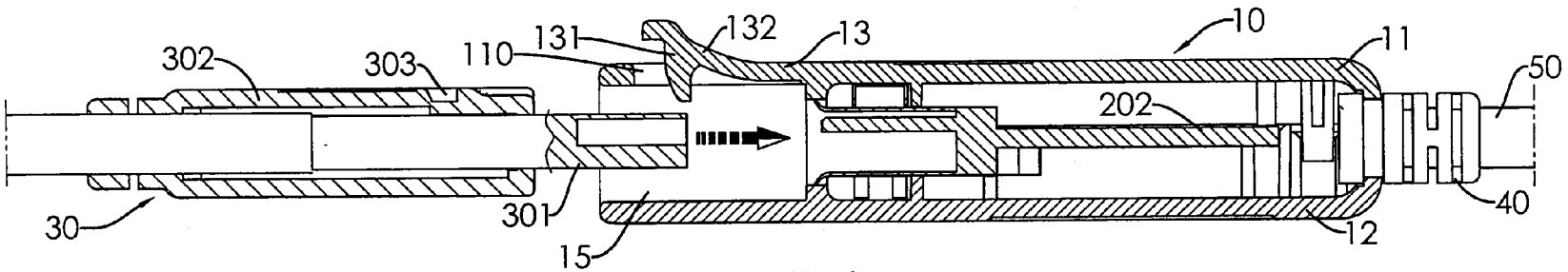
FIG. 5 is a cross-sectional view of the connector with an anti-loose fastening device, shown a plug module being partially inserted in a socket.

The operation of the present invention is described next. With reference to FIG. 5, when the plug module (30) is inserted in the housing (10), due to the inwardly slanted surface of the tooth (131), the grip portion (302) of the plug module (30) is pushed in along the inwardly slanted surface to prop up the elastic finger (13) so that the male plug (301) of the plug module (30) is smoothly plugged in the socket (201) to electrically connect therewith.

Figure 6:
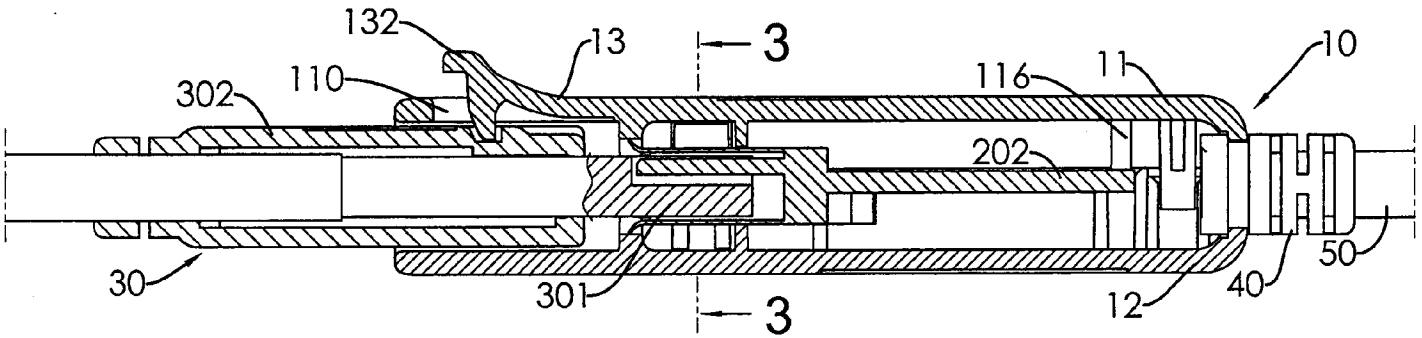
FIG. 6 is a cross-sectional view of the connector with an anti-loose fastening device, shown a plug module being fully inserted in the socket.

With reference to FIG. 6, then the tooth (131) is retained in the recess (303) of the plug module (30) by using the restoring elasticity of the elastic finger (13) to result in a fastening effect.

Figure 7:
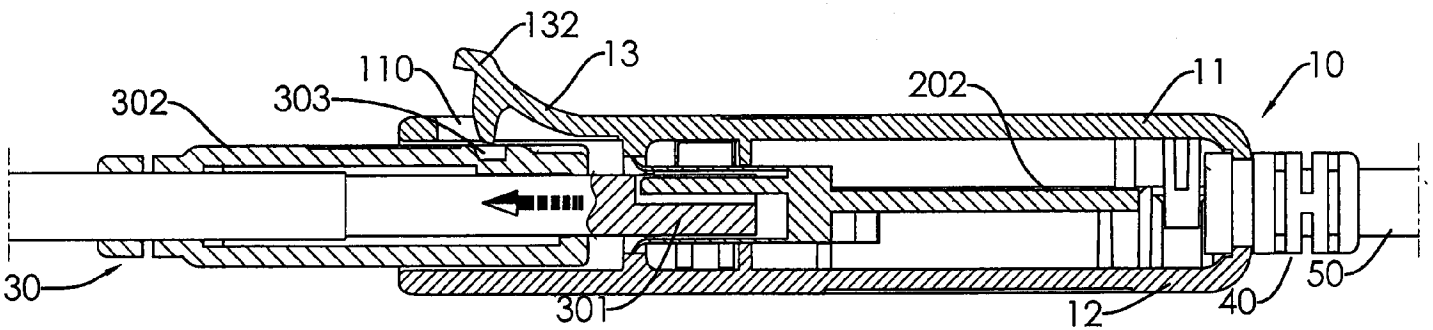
FIG. 7 is a cross-sectional view of the connector with an anti-loose fastening device, shown a plug module being loosened from the socket.

With reference to FIG. 7, when the plug module (30) is pulled out the housing (10), the release portion (132) of the elastic finger (13) is pulled up so that the tooth (131) is disengaged with the recess (303) of the male plug (301). The male plug (301) can thus be pulled out the socket (201) of the socket module (20) to electrically disconnect therewith.

From the foregoing description, the elastic finger (13) on the housing (10) generating a fastening effect to an inserted plug module (30) and the socket module (20) tightly connected with the plug can effectively prevent the plug module (30) from being loose and easily coming off.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A connector with an anti-loose fastening device, comprising:

a housing having a chamber defined therein;

a front opening formed through a front end thereof;

a through slot formed through the housing and abutting the front end of the housing; and an elastic finger mounted inside the through slot, and having one end connected with a rear edge of the through slot, the other end being a flexible free end abutting the front end of the housing, and a tooth extending downwardly from the free end and protruding downwardly beyond the through slot;

a socket module mounted in the chamber, abutting the front opening, and having a circuit board;

a socket connected to the circuit board and facing the front opening of the housing; and a transmission cable connected with the circuit board; and a plug module selectively inserting into and electrically connecting with the socket module and having a grip portion having a recess formed thereon and corresponding to the tooth of the elastic finger mounted on a top cover; and a male plug mounted on one end of the grip portion to electrically connect with the socket module.

2. The connector with an anti-loose fastening device as claimed in claim 1, wherein the housing comprises:

a bottom cover having a bottom board;

two sidewalls respectively extending perpendicularly and upwardly from two edges of the bottom board;

two lower tongues formed on the bottom board; and two buckles formed on the bottom board;

the top cover attached to the bottom cover and having a top board;

two sidewalls respectively extending from two edges of the top board perpendicularly and downwardly;

two upper grooves, each upper groove formed in an inner periphery of a corresponding sidewall of the top cover and engaging with a corresponding lower tongue of the bottom cover;

two upper tongues formed on an inside surface of the top board and respectively engaging with the two buckles on the bottom cover;

an indicator hole formed through the top board thereof; and two pins formed on the inside surface of the top board urged against the circuit board;

the through slot of the housing is formed through the top board of the top cover; and the free end of the elastic finger comprises a release portion protruding upwardly beyond the through slot of the top cover; and an inwardly slanted surface facing the front opening.

3. The connector with an anti-loose fastening device as claimed in claim 2, wherein the socket module further has an indicator mounted on the circuit board and corresponding to the indicator hole, and a cable seat mounted within the rear opening to receive the transmission cable therein.

4. The connector with an anti-loose fastening device as claimed in claim 3, the socket of the socket module is a USB socket, the male plug of the plug module is a USB plug.

5. The connector with an anti-loose fastening device as claimed in claim 1, the socket of the socket module is a USB socket, the male plug of the plug module is a USB plug.

* * * * *